US005357888A

United States Patent [19]

Insinna

[11] Patent Number: 5,357,888

[45] Date of Patent: Oct. 25, 1994

[54] EMERGENCY FLOATATION SYSTEM FOR A WATER CRAFT

[76] Inventor: David E. Insinna, 2819 Nassau St., Sarasota, Fla. 34231

[21] Appl. No.: 163,934

[22] Filed: Dec. 8, 1993

[51] Int. Cl.[5] ..... B63B 43/10

[52] U.S. Cl. ..... 114/69; 114/219

[58] Field of Search ..... 114/68, 69, 219

[56] References Cited

U.S. PATENT DOCUMENTS

| | | | |
|---|---|---|---|
| 3,952,350 | 4/1976 | Moucka | 114/68 |
| 4,867,094 | 9/1989 | Binks | 114/69 |
| 4,996,936 | 3/1991 | Brundritt | 114/68 |

*Primary Examiner*—Jesus D. Sotelo

*Attorney, Agent, or Firm*—Charles J. Prescott

[57] ABSTRACT

An emergency floatation system for a water craft including an elongated inflatable buoyancy tube positioned within an interior volume defined by a contour molded cover whose perimeter is sealingly mated around a somewhat flat base member against the hull outer surface. One such assembly is connected and extending longitudinally along each side of the boat hull near the water line of the water craft. A source of compressed gas within the water craft inflates each buoyancy tube, triggered either manually or by a separate sensing unit responsive to a preselected sea water pressure or depth above the sensing unit as when the water craft is partially submerged.

4 Claims, 3 Drawing Sheets

EMERGENCY FLOATATION SYSTEM FOR A WATER CRAFT

BACKGROUND OF THE INVENTION

1. Scope of Invention

This invention relates generally to water craft and floatation therefor, and more particularly to an emergency floatation system for supporting a water craft in emergency situations.

2. Prior Art

The use of water craft and the general availability of pleasure-type water craft has drastically increased in recent years. Heretofore, the majority of water craft used off shore were of a commercial or military nature. However, pleasure craft have become considerably larger in size, more sophisticated and significantly more capable of sustaining heavier seas and for prolonged periods as when cruising or fishing offshore.

Additionally, the sophistication and increased cost of manufacture of water craft have combined to render the insurance rates of such water craft substantially higher than in the past. Replacement in a total loss situation as when the vessel is sunk and rendered unrecoverable, have further combined to increase the insurance risk and costs thereof.

Because of this wider ranging capability of pleasure craft, it has become increasingly difficult for U.S. Coast Guard services, other emergency services, and other pleasure craft in the area to reach a vessel in distress in a timely fashion. As a result, the number of vessels which are lost at sea by sinking has increased drastically.

The net result of the above changes in water craft circumstances has created a significant need for providing an emergency buoyancy system which will maintain an otherwise sinking vessel afloat so that emergency personnel and vessels may be of use to prevent loss of life and vessel.

Additionally, the overall aesthetic appearance of modern pleasure craft has become much more sophisticated and significant, playing a very important role in the marketability of each line of new pleasure-type water craft. These demanding aesthetics, therefore, place a similar requirement upon any emergency floatation system which may be incorporated into such modern water craft.

One device which arguably accomplishes some of the above objectives is disclosed in U.S. Pat. No. 3,121,888 invented by Morgan teaching a water craft preserver which is connected along each gunnel of the water craft. The device includes an inflatable cylindrical member which is held in an uninflated position within a J-shaped cross section resilient member. However, the Morgan device is aesthetically unpleasing and provides only manual activation of a compressed gas cylinder positioned at the aft end of each inflatable cylinder.

In U.S. Pat. No. 4,864,961, Slonski has invented an auxiliary floatation system which houses a deflated sheath positioned within a cylindrical canister mounted transversely to an opening of a side surface of the hull. When triggered as by a pressure source or manual activation, the sheath is inflated, forcing a piercing arrangement outwardly through a circular disc which otherwise seals the entire arrangement at the outer surface of the hull. The Slonski device, therefore, requires substantial modification to an interior intrusion of the hull to incorporate this system into a water craft.

Meinen, in U.S. Pat. No. 4,817,555 teaches a boat floatation collar which is housed within a generally U-shaped upwardly oriented bumper guard positioned longitudinally along the gunnel of the water craft. A water level float triggers the opening of the compressible gas bottle to inflate the pneumatic cells positioned within the bumper guard which inflate and support the water craft from sinking. Again, the Meinen device is somewhat unattractive when positioned as described along the gunnel of a water craft. Further, none of the references described in the background of Meinen do not disclose structural elements or benefits of the present invention.

In U.S. Pat. No. 4,458,618, Tuffier teaches a safety device for rendering a sailboat unsinkable. The device includes three inflatable envelopes which are placed in the bunk area of the water craft. Covington, in U.S. Pat. No. 4,625,674 also teaches a gunnel floatation pipe and method for an aluminum boat, the floatation pipe being welded to the aluminum gunnel.

The present invention provides an emergency floatation system which will maintain a water vessel afloat at its normal water depth and to prevent sinking thereof. The system includes aesthetically pleasing covers along or just below the water line or chine area of each side of the hull extending from the transom forward which serve to house inflatable buoyancy tubes contained therein. The covers are detached and freed from a support base member when the buoyancy tubes are activated and filled for buoyancy by a source of compressed gas aboard the water craft. Triggering of the present invention may be either manually or by a sensor which is activated at a prescribed water depth or pressure above the sensor as when the water craft is partially sunk. By so positioning the buoyancy tubes, the vessel will remain afloat with minimal interior water damage and be able to make way or be towed safely to port.

BRIEF SUMMARY OF THE INVENTION

This invention is directed to an emergency floatation system for a water craft including an elongated inflatable buoyancy tube positioned within an interior volume defined by a contour molded cover whose perimeter is sealingly mated around a somewhat flat base member against the hull outer surface. One such assembly is connected and extending longitudinally along each side of the boat hull near the water line of the water craft. A source of compressed gas within the water craft inflates each buoyancy tube, triggered either manually or by a separate sensing unit responsive to a preselected sea water pressure or depth above the sensing unit as when the water craft is partially submerged.

It is therefore an object of this invention to provide an emergency floatation system for water craft which may be incorporated therewithin in an aesthetically pleasing manner so as not to disrupt the stylized lines and look of the water craft.

It is another object of this invention to provide a economically manufactured emergency floatation system which is easily attachable to the lower chine area near, and preferably just below, the water line area of a water craft when at rest.

It is yet another object of this invention to provide an emergency floatation system for a water craft which may be triggered either manually or by a water pressure sensor which is activated at a prescribed water pressure or depth of water above the sensor.

It is still another object of this invention to provide an emergency buoyancy system for a water craft which may be both easily retrofitted to existing water craft or incorporated into newly manufactured units.

It is yet another object of this invention to maintain a damaged and sinking water craft at its normal water depth so as to minimize water intrusion and to allow the damaged watercraft to be safely returned to port.

In accordance with these and other objects which will become apparent hereinafter, the instant invention will now be described with reference to the accompanying drawings.

DETAILED DESCRIPTION OF THE INVENTION

Figure 1:
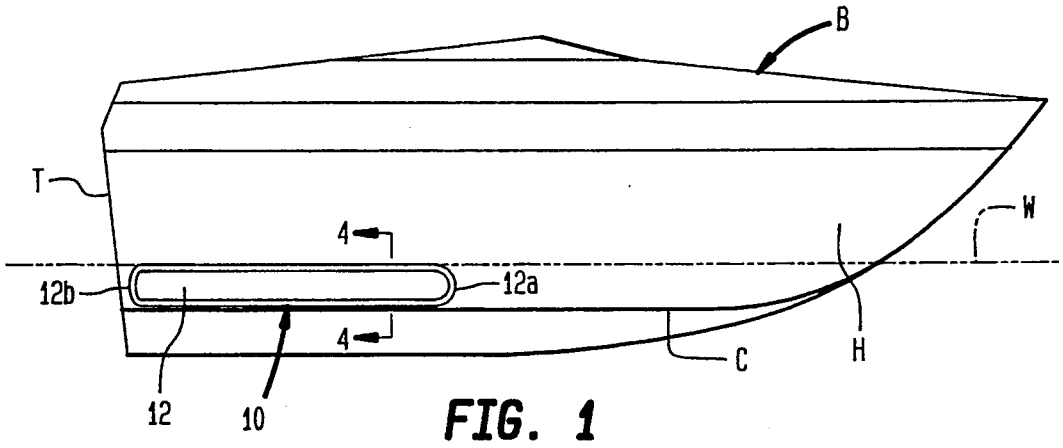
FIG. 1 is a side elevation view of a stylized, modern pleasure craft with the invention installed thereon.

Referring now to the drawings, the invention is shown generally at numeral 10 connected along outer hull surface H of a water craft B on both sides of the hull H. The system 10 is preferably positioned immediately along the chine C of the boat which is typically at or just below the water line level W and extending forwardly of the transom T of the water craft B.

Figure 3:
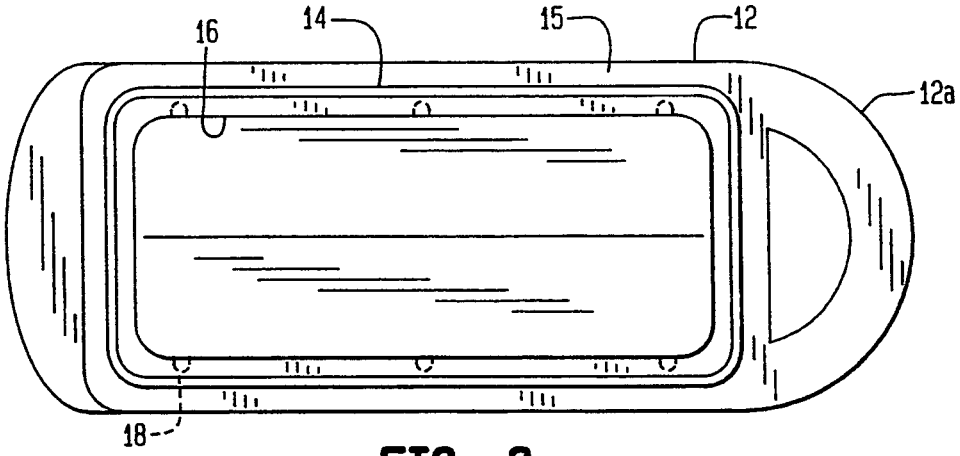
FIG. 3 is a side elevation view of the inner sealing surface of a cover of the invention shown in FIG. 1.

The system 10 includes a contour molded advanced composite cover 12, the inner sealing surface 15 and side elevation profile of which are best seen in FIG. 3. The cover 12 includes rounded and contoured forward and rearward ends 12*a* and 12*b* for both style and reduced water and wind resistance.

Thus, there are at least two factors which contribute to the aesthetically pleasing aspects of the present invention, the first being the overall position of the device 10 at or below the water line W so as not to be substantially viewable when the water craft B is at rest and the second being the contoured configuration of the ends 12*a* and 12*b* of cover 12.

Figure 4:
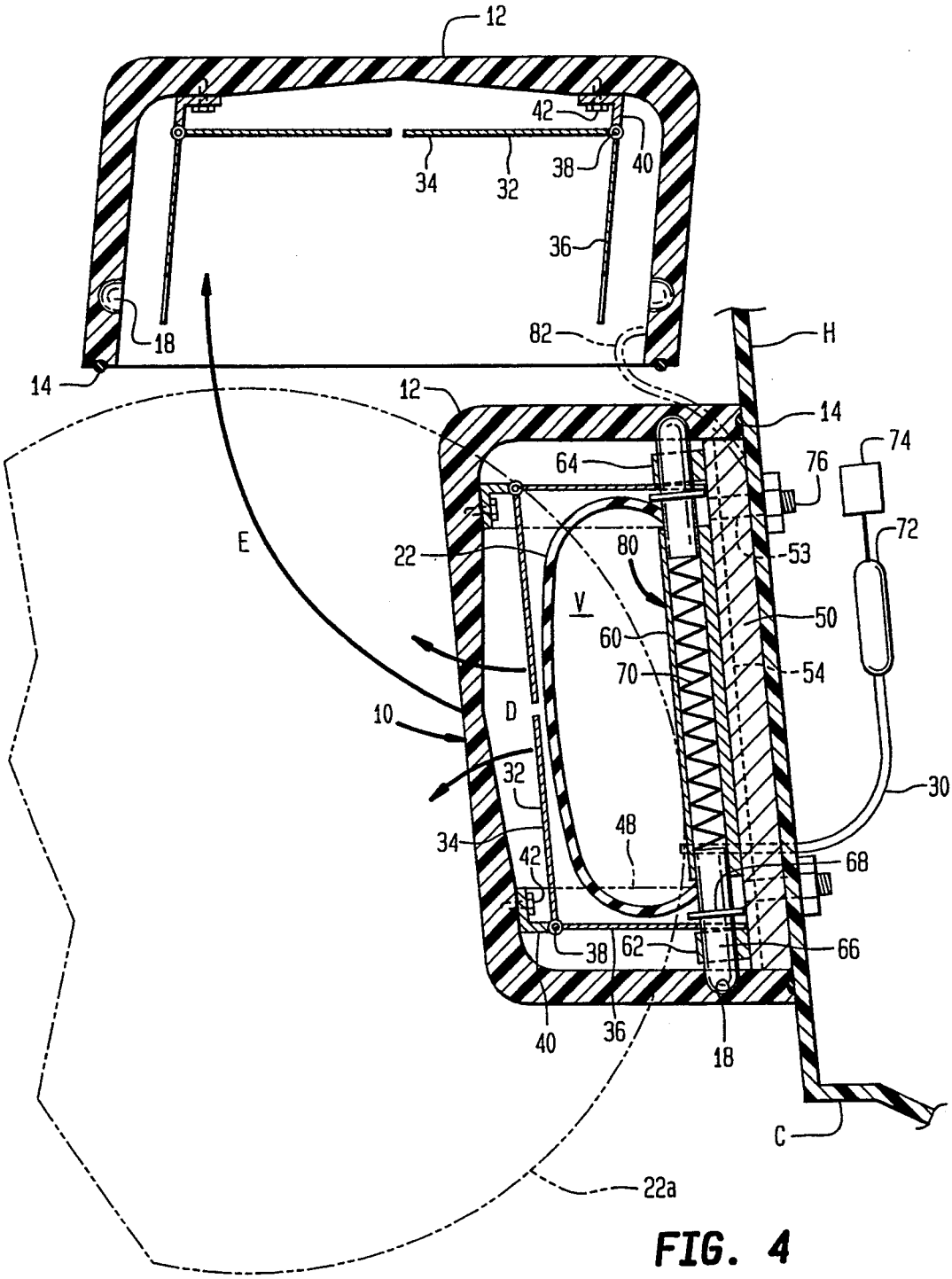
FIG. 4 is a section view in the direction of arrows 4—4 in FIG. 1 showing the buoyancy tube inflated in phantom.
Figure 6:
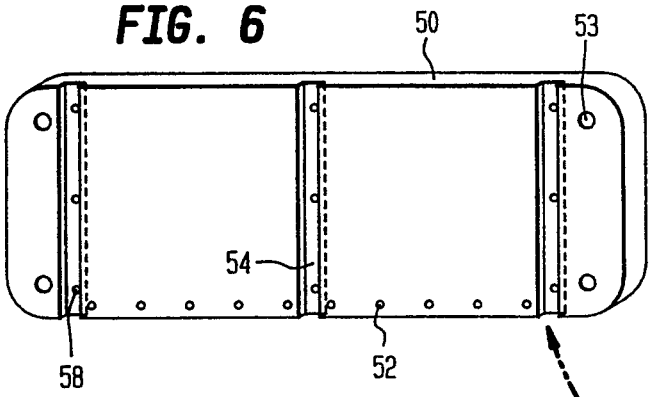
FIG. 6 is a perspective view of the base member of the invention which is connectable directly against the outer hull surface of the water craft.

As best seen in FIG. 6, a generally rectangular base member 50 is connected against the hull H by threaded fasteners 76 seen in FIG. 4 which interengage through holes 53 and a mating hole formed or drilled through the hull H. The base member 50 includes a plurality of upright channels 54 formed in the outer face thereof, the opposite generally flat surface being connected directly against the hull H.

Figure 2:
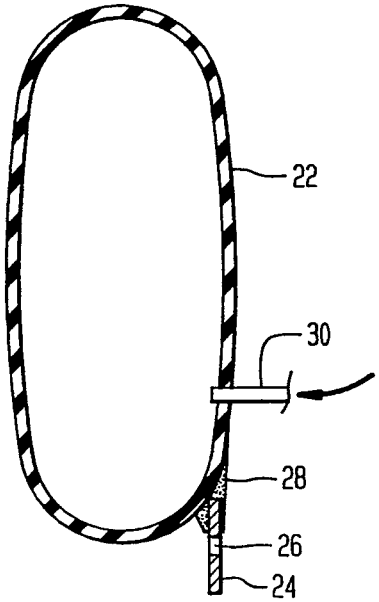
FIG. 2 is a cross section view of the inflatable buoyancy tube of the invention.

As best seen in FIGS. 2 and 4, positioned within an interior volume V defined by the inner surface of the cover 12 in position around the outer surface of base member 50 is an elongated inflatable elastomeric buoyancy tube 22. This buoyancy tube 22 includes an elongated metal mounting flange 24 having a plurality of mounting holes 26 formed therein, the mounting flange 24 being vulcanized by elastomeric material 28 against the buoyancy tube 22 as seen in FIG. 2. An air conduit 30 is also provided for introduction of compressed air in the direction of the arrow in FIG. 2 to inflate the buoyancy tube 22 when required.

The interior volume V is rendered water impervious by a continuous O-ring member 14 positioned between the inner perimeter surface 15 of cover 12 and the outer surface of the hull H.

Figure 7:
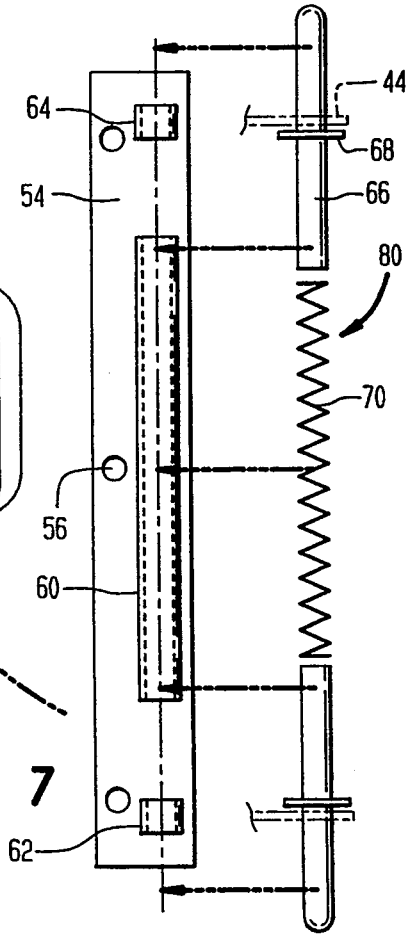
FIG. 7 is an exploded elevation view of the cover locking assembly which is connectable to the base member of FIG. 6 as shown by the arrow in phantom.

Cover 12 includes an inner wall surface 16 which closely mates around the generally rectangular perimeter of base plate 50 and is retained and is secured in that position by a plurality of lock assemblies 80 which are best seen in FIGS. 4 and 7. These lock assemblies 80 include an elongated mounting base 54 having axially aligned spaced tubes 60, 62 and 64 welded or formed thereon. A compression spring 70 generally fits within tube 60 with movable opposing cylindrical locking pins 66 positioned at each end thereof, partially supported within each end of tube 60 and fully within tubes 62 and 64. A snap ring 68 positioned on each locking pin 66 acts against one end of tubes 62 and 64 to prevent disengagement. The mounting base 54 is secured by threaded fasteners (not shown) fitted through mounting holes 56 and into threaded holes 58. The distal ends of locking pins 66 are forcibly urged by compression spring 70 into locking engagement within aligned mating cavities 18 formed opposingly into the side walls 16 of cover 12 to secure the cover 12.

A source of compressed gas 72, interconnected by tubular member 30 to buoyancy tube 22, provides the source of gas necessary to inflate the buoyancy tube 22 in an emergency situation. To trigger the release of the compressed gas source 72, a manual switch may be provided as at 74 or alternately, this switch 74 may incorporate a pressure sensing unit therewithin which will trigger the release of compressed gas at a preselected water pressure level above the sensing unit within 74. By this preferred arrangement, the system 10 will only be triggered into emergency use as when the water craft B is sinking and partially submerged so that there is a water pressure head existing above unit 74. Any desired water level existing within the water craft B may thus be determined by the appropriate height placement of triggering unit 74 within the hull H.

Figure 5:
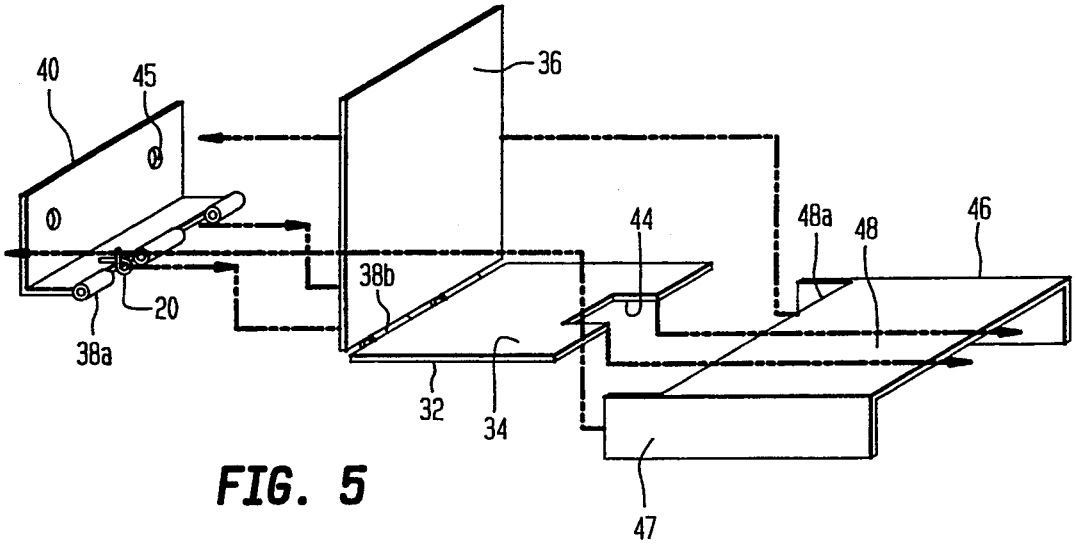
FIG. 5 is an exploded perspective view of the cover release mechanism.

The preferred release arrangement is provided as best seen in FIGS. 4 and 5. An L-sectioned lock release 32 is provided for each lock arrangement of FIG. 7. This lock release 32 is pivotally connected at hinge 38*b* to a mating hinge arrangement 38*a* of L-bracket 40 which, in turn, is connected through holes 45 by threaded fasteners against the inner surface of the cover 12 as best seen in FIG. 4. The locking release 32 includes horizontal panel 34 having a notch 44 along its free edge which interengages against the snap ring 68 as seen in FIG. 4. By this arrangement, when upright panel 36 is forcibly urged in the direction of arrow D by the inflation of buoyancy tube 22, notch 44 acts against snap rings 68 to move the lock pins 66 inward to release the cover 12. The cover 12 immediately is thrown free of the base member 50 as in the direction of arrow E to then allow for the free, full expansion of buoyancy tube 22. Flexible tethers 82 in FIG. 4 may also be provided to prevent loss of the detached covers 12.

A hinge spring 20 in FIG. 5 serves to forcibly urge upright panel 36 against the edge 48*a* of panel 48 so as to maintain alignment of notches 44 parallel to the corresponding snap rings 68 as shown in FIGS. 4 and 7.

To prevent interference of the free pivoting of release member 32 about hinge 38*b* when the buoyancy tube 22 begins to inflate in an emergency situation, a separate protective shield 46 is also provided which is connected at tabs 47 to bracket 40 as best seen in FIGS. 4 and 5. This shield 46 has an upper panel 48 which is spaced apart from panel 34 a distance which allows release member 32 to pivot sufficiently in the direction of arrows D so as to disengage locking pins 66 from cover 12 as previously described. Thus, panel 48 prevents the inflating buoyancy tube 22 from contacting panel 34 which would otherwise interfere with the free pivotal movement of release member 32 in the direction of arrow D.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An emergency floatation system for a water craft consisting essentially of:

an elongated rigid cover sealingly positioned at a perimeter thereof against a mating generally flat base member, said cover and base member separate one to another and defining an elongated interior volume;

one said base member connected longitudinally against an exterior hull surface of each side of the water craft immediately above and along a chine of the water craft and near to a water line of the water craft, said base member extending forwardly from a stern area of the water craft and laterally outward from a generally uninterrupted hull contour of the water craft;

an elongated inflatable buoyancy tube which, in a normally deflated condition, is positioned within and generally coextensive with, said interior volume;

releasible connecting means positioned within said interior volume for interconnecting said cover and base member, said releasible connecting means permitting forcible detachment of said cover from said base member when said buoyancy tube is inflated, said buoyancy tube in a fully inflated condition defining a volume larger than said interior volume;

a source of compressed gas positioned within said water craft and operably connected to each said buoyancy tube, said compressed gas source containing a volume of compressed gas sufficient to fully inflate each said buoyancy tube;

means operably connected to said compressed gas source for releasing compressed gas from said compressed gas source to inflate each said buoyancy tube.

2. An emergency floatation system for a water craft comprising:

an elongated cover sealingly positioned at a perimeter thereof around a mating base member, said cover and base member separate one to another and defining an elongated interior volume;

one said base member with said cover connected thereto connected longitudinally to an exterior hull surface of each side of the water craft near to a water line of the water craft, said base member extending forwardly from a stern area of the water craft;

an elongated inflatable buoyancy tube which, in a normally deflated condition, is positioned within and generally coextensive with, said interior volume;

releasible connecting means positioned within said interior volume for interconnecting said cover and base member, said releasible connecting means permitting forcible detachment of said cover from said base member when said buoyancy tube is inflated, said buoyancy tube in a fully inflated condition defining a volume larger than said interior volume;

a source of compressed gas positioned within said water craft and operably connected to each said buoyancy tube, said compressed gas source containing a volume of compressed gas sufficient to fully inflate each said buoyancy tube;

means operably connected to said compressed gas source for releasing compressed gas from said compressed gas source to inflate each said buoyancy tube;

said releasible connecting means including a double-ended spring biased cover lock having a locking pin extending longitudinally from each end of a tubular support member, said tubular support member connected transversely to said base member wherein each said locking pin biasingly engages into a mating cavity formed into opposingly facing walls of said cover to secure said cover and base plate together; and said lock being forcibly overcome to release and detach said cover from said base plate when said buoyancy tube is inflated.

3. An emergency floatation system for a water craft comprising:

an elongated cover sealingly positioned at a perimeter thereof around a mating base member, said cover and base member separate one to another and defining an elongated interior volume;

one said base member with said cover connected thereto connected longitudinally to an exterior hull surface of each side of the water craft near to a water line of the water craft, said base member extending forwardly from a stern area of the water craft;

an elongated inflatable buoyancy tube which, in a normally deflated condition, is positioned within and generally coextensive with, said interior volume;

releasible connecting means positioned within said interior volume for interconnecting said cover and base member, said releasible connecting means permitting forcible detachment of said cover from said base member when said buoyancy tube is inflated, said buoyancy tube in a fully inflated condition defining a volume larger than said interior volume;

a source of compressed gas positioned within said water craft and operably connected to each said buoyancy tube, said compressed gas source containing a volume of compressed gas sufficient to fully inflate each said buoyancy tube;

means operably connected to said compressed gas source for releasing compressed gas from said compressed gas source to inflate each said buoyancy tube;

said releasable connecting means including a double-ended spring biased cover lock having a locking pin extending longitudinally from each end of a tubular support member, said tubular support member connected transversely to said base member wherein each said locking pin biasingly engages into a mating cavity formed into opposingly facing walls of said cover to secure said cover and base plate together; and means acted upon by said buoyancy tube during inflation thereof for automatically withdrawing each said locking pin from each said cavity to release said cover from said base plate.

4. An emergency floatation system as set forth in claim 3, further comprising:

water depth sensing means operably connected to said compressed gas releasing means for releasing compressed gas from said compressed gas source at a preselected depth of sea water thereabove.

* * * * *